United States Patent [19]

White

[11] 3,974,465

[45] Aug. 10, 1976

[54] MICROWAVE DEVICE ASSEMBLIES

[75] Inventor: Joseph F. White, Lexington, Mass.

[73] Assignee: Microwave Associates, Inc., Burlington, Mass.

[22] Filed: Dec. 24, 1974

[21] Appl. No.: 536,112

[52] U.S. Cl. ..... 333/31 R; 333/7 D; 333/84 M

[51] Int. Cl.[2] ..... H01P 1/18; H01P 5/04; H01P 5/08; H01P 3/08

[58] Field of Search ..... 333/31 R, 84 R, 84 M, 333/7 R, 7 D, 97 S, 97 R, 7 D, 17 L

[56] References Cited

UNITED STATES PATENTS

| | | | |
|---|---|---|---|
| 3,013,227 | 12/1961 | Jordan | 333/84 M X |
| 3,328,730 | 5/1967 | Dowdell, Jr. | 333/84 R |
| 3,417,294 | 12/1968 | Steidlitz | 333/84 R X |
| 3,538,465 | 11/1970 | Manning, Jr. et al. | 333/84 M X |
| 3,571,762 | 3/1971 | Smilen | 333/84 M X |
| 3,757,259 | 9/1973 | Jones et al. | 333/84 M |

*Primary Examiner*—Saxfield Chatmon, Jr.
*Assistant Examiner*—Marvin Nussbaum
*Attorney, Agent, or Firm*—Alfred H. Rosen; Frank A. Steinhilper

[57] ABSTRACT

A multiport phase shifter for microwave energy provides four output components of an input wave each shifted a prescribed amount in phase, in an enclosure having two plates held together by studs mounted on one of them for locating a power divider and four independent phase-shift branches, and independent diode mounts for each, and for spacing the plates the correct distance to serve as ground planes for TEM-mode lines within the enclosure. Phase trimmers at each output port serve to adjust the output phase relations to a specification without requiring any invasion of the enclosure.

7 Claims, 9 Drawing Figures

FIG. 3
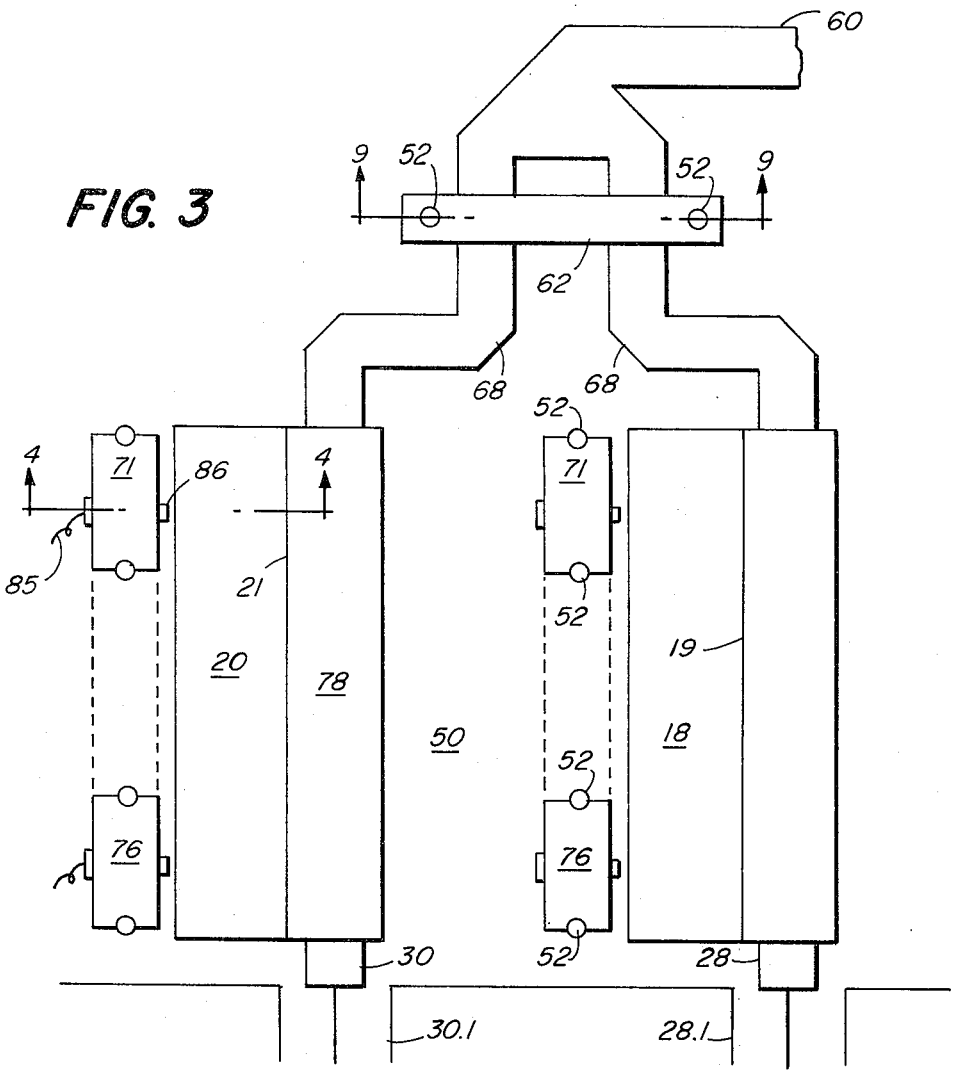
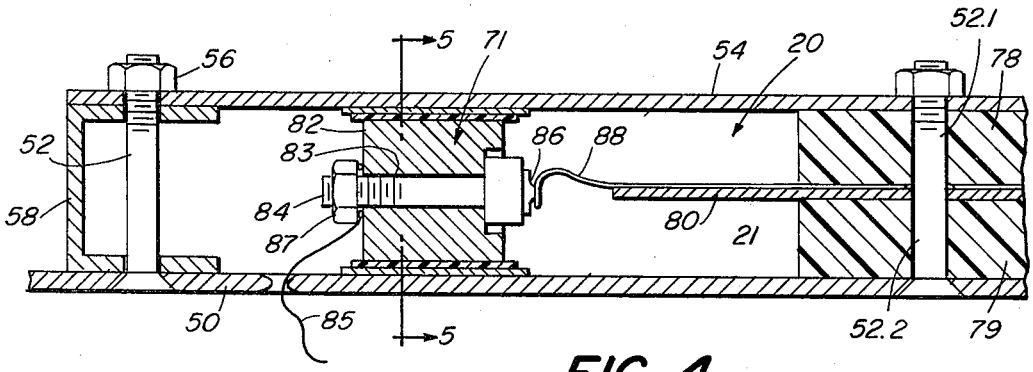
FIG. 4

MICROWAVE DEVICE ASSEMBLIES

BACKGROUND OF THE INVENTION

Systems that handle, process or use electric wave energy are composed of subsystems, subassemblies and components that may be made by various different manufacturers, to specifications imposed by others, and under conditions requiring not only that the specifications be met, but also that they be met economically and repeatedly from one manufacturing run to another. Particularly in the very high frequency regions and above, for example the microwave area around 1.0 $GH_z$, these requirements present a challenge that is not readily met with techniques that are generally available. As one example, a device that is designed to accept an input wave from which it presents at several outputs components of that wave bearing prescribed different phase relations to each other may be most conveniently and economically realized using diode phase shifters cooperating with a TEM-mode transmission line net of the strip-transmission line variety, the whole being enclosed in an electrically-conductive case for physical strength and electrical shielding. Each component and subassembly of this device will present its own design problems.

While the TEM-mode line net may propagate the useful wave energy in the desired frequency band, the enclosure may support other modes, known sometimes as "box resonance modes" that sap energy from the useful energy and degrade operation of the device. The TEM-mode line itself has to be handled in a way that will preserve its balance and avoid the setting up of fields which could induce such "other mode" energy into the enclosure. The enclosure and the TEM-mode line structure must be assembled in a way that assures minimum physical distortion of the line structure, and maintains its dimensional stability not only throughout each device, but also from one device to the next. At the same time, the enclosure should be designed to discourage the presence in it of box resonance modes of wave energy. The phase shift at each terminal must be set to the performance specification reliably, and preferably in a way that will not require any degree of disassembly of the device in order to make final or trim adjustments after the device has been assembled. The assembly technique must, in addition to taking into account all of the above-mentioned considerations, be inexpensive in both the materials and the labor that are used. These requirements and desired results are applicable, with necessary changes in particulars, to a wide variety of electric wave propagating and supporting devices.

GENERAL NATURE OF THE INVENTION

Employing as its vehicle for illustration a multi-port phase shift device intended for operation in a microwave-frequency range, the present invention brings together cooperatively several techniques to provide such devices at low cost which repeatedly and accurately meet structural and performance specifications. A case made of electrically-conductive sheet metal has two opposed cover plates one of which is fitted with studs to hold the other to it a fixed spacing away. The two opposed cover plates may be the ground-plane conductors of TEM-mode double-ground-plane strip transmission line sections that are used to guide microwave energy through the device, and the studs are used in cooperation with spacers or solid dielectric members to support strip conductors between them.

Diode mount structures for holding diodes in the structure are provided in a form that simultaneously maintains the spacing between the cover plates, locates a diode or diodes between the plates for electrically-balanced coupling to the strip conductors with provision for bringing dc bias voltage to each diode, and includes RF by-pass paths to the respective ground plane conductors. The mount structure for each diode is a separate rigid physical entity that fits between the cover plates which can be clamped to it by simply tightening nuts on the above-mentioned studs.

The entire structure is assembled by putting the components, such as TEM-mode line parts and diode mounts with diodes, on the cover plate having studs, assembling the electrical circuit, putting the opposing cover in place over the circuit components and studs, and fastening it together with nuts on the free ends of the studs, preferably with a torque wrench. Output couplers, for example, coaxial couplers, are fitted to the outside of the casing at each output phase port. To adjust, trim, or offset the phase of the wave available at each port, there is also provided a plurality of coaxial trim sections each having the same exterior physical length and diameter, and the same characteristic impedance, but a unique electrical length corresponding to a preselected increment of phase shift. Each port is phase-trimmed or offset by attaching an appropriate trim or offset section to its output coupler, and this is done outside the assembled structure.

The combination of a plate-and-stud mechanical construction, with supports and spacers to locate and hold a TEM-mode center conductor between two cover plates, diode holders which incorporate RF filters in a structure that supports the cover plates in their assembled positions, and external tunable couplers at the output phase ports, yields a phase shifter having the desired electrical and mechanical properties. To enhance these properties, the studs are so located between the cover plates as to short out fields of undesired box resonance modes.

The coaxial phase trim sections may be made according to techniques known, for example, in "Microwave Transmission Circuits" Vol. 9, Radiation Laboratory Series, McGraw-Hill Book Company, Inc., 1948, pages 163–165, dealing with Undercut Bead Supports. Each section is furnished with a removable center conductor and a dielectric insert, which can be changed to alter the electrical length of the section.

BRIEF DESCRIPTION OF THE DRAWINGS

FIG. 3 illustrates certain details in FIG. 2;

FIG. 4 is a section along line 4—4 of FIG. 3;

DETAILED DESCRIPTION OF THE DRAWINGS

Figure 1:
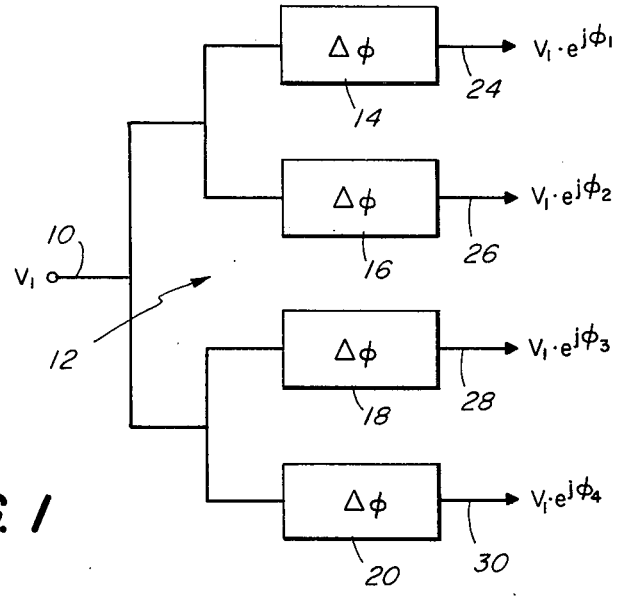
FIG. 1 is a schematic drawing of the electrical circuit of a phase shifter having four output ports.

In FIG. 1 an input terminal 10 accepts input wave energy, designated $V_1$ and applies it to a power divider 12 of known form using TEM-mode transmission line sections (for example a Wilkinson power-divider), to present respective equal increments of the input energy to a plurality of phase shifters 14, 16, 18 and 20. The phase shifters are also of known form and each provides at its output 24, 26, 28, 30, respectively, a wave having a prescribed phase relation $e^{j\phi_1}$, $e^{j\phi_2}$, $e^{j\phi_3}$ or $e^{j\phi_4}$, respectively, to the input wave, an expression of the relative phase relationships being indicated on the drawing. FIG. 1 shows a microwave system to which the invention is applicable, and in connection with which the invention is herein described.

The following description refers collectively to FIGS. 2, 3, 4, 5, 7 and 9, which are different views of the same thing. A base plate 50, made of electrically-conductive sheet material (e.g.: aluminum or brass) is fitted with a plurality of threaded studs 52. The studs serve a number of purposes simultaneously. They are primary assembly means holding the structure together. They are also mode suppressors of box resonances, and they are parts of spacers for the TEM-mode transmission line sections used in the device. A cover plate 54, also made of electrically conductive sheet material, is apertured in locations corresponding to the stud locations on the base plate and in the assembled structure fits over the studs and is fastened with nuts 56. An edge rail 58, of U-shaped cross section (as seen in FIG. 4) is fitted between the plates 50, 54 at their peripheries, surrounding the assembled structure on all sides, and holds the two plates a prescribed distance apart. The edge rail 58 is also made of an electrically conductive sheet material. The two plates 50, 54 and the edge rail 58 form an electrically conductive enclosure which is also an electrostatic shield for the microwave circuit components that are assembled and supported within it.

Figure 2:
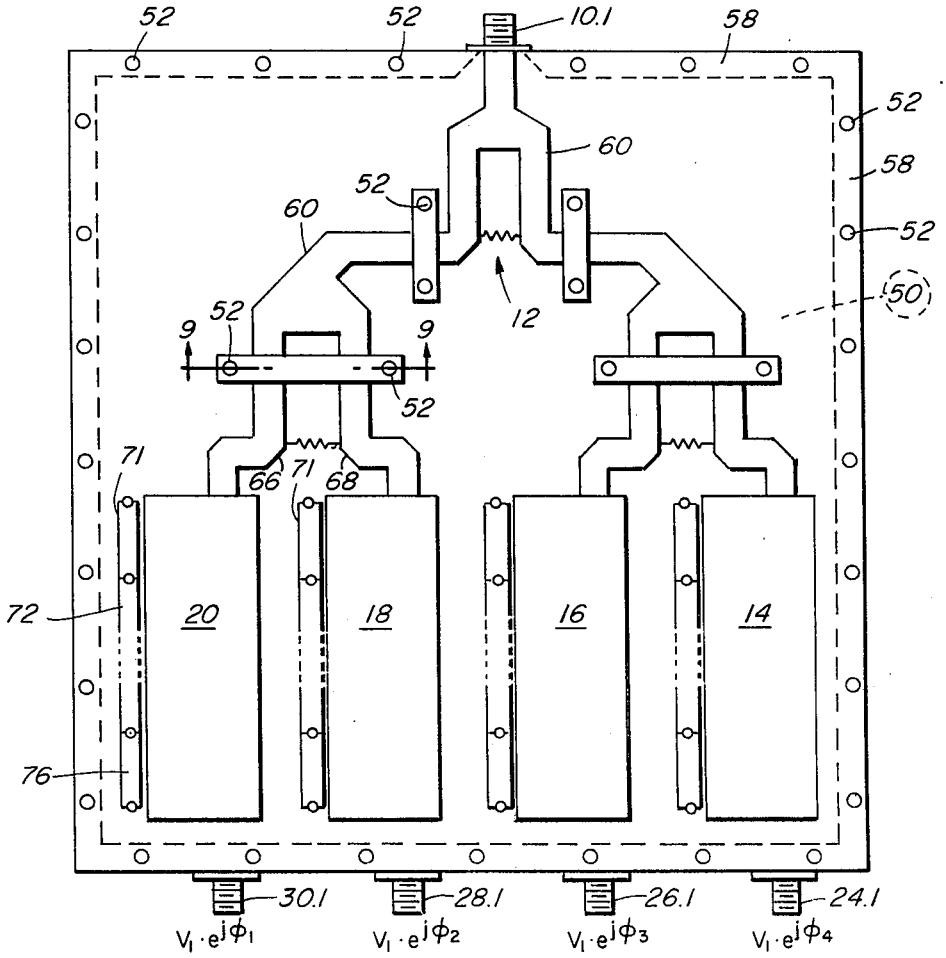
FIG. 2 is a plan view of a phase shifter according to the invention which employs the circuit of FIG. 1.
Figure 9:
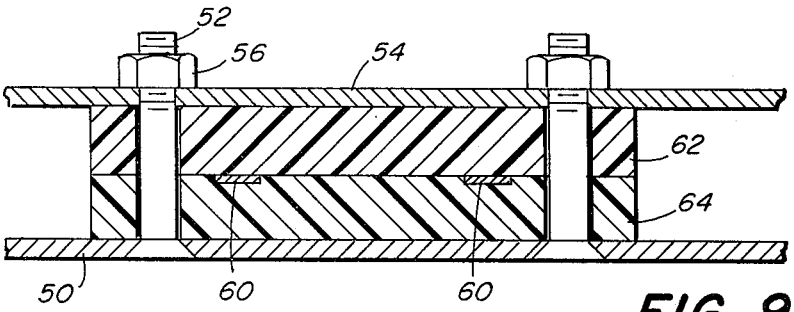
FIG. 9 is a section on line 9—9 of FIG. 3.

The power divider 12 is made of air-dielectric double-ground-plane strip transmission line having the two plates 50, 54 as its ground plane conductors and a strip conductor 60 supported between them by some of the studs 52 and cooperating dielectric spacers 62, 64 as shown for example in FIG. 9. The strip conductor 60 is made of electrically-conductive sheet material (e.g.: copper), and is connected at the input end 10 to a coaxial connector 10.1 (of known form) that is fitted to an outer surface of the edge rail 58. The strip conductor is shaped to provide the required power division of input energy, and the studs 52 which support it are also located in positions relative to the strip conductor that will enhance their effectiveness in reducing box resonances. For example, the studs 52 on the section 9—9 in FIG. 2 and FIG. 9 are located near bends 66 and 68 in the strip conductor 12. Distortions of the electric and magnetic fields that give rise to energy in unwanted modes are known to occur in the vicinity of such bends. The studs near these bends act as electrical short-circuit paths in the locations where those field distortions occur, and thereby reduce the effective amplitude of energy in unwanted modes to which the enclosure or box 50, 54, 58 might resonate.

Figure 5:
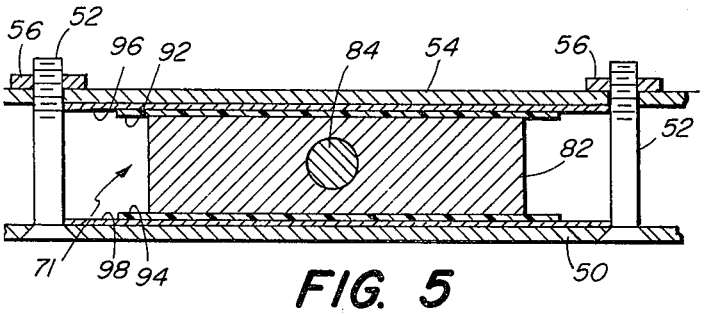
FIG. 5 is a section along line 5—5 of FIG. 4.

The phase shifters 14, 16, 18 and 20 are of known form the details of which are not per se a part of the invention, and for that reason they are illustrated in general outline only. FIG. 2 shows the location of each phase shifter between the power divider 12 and one of the output terminals 24, 26, 28, 30, respectively, the latter being connected to coaxial output couplers 24.1, 26.1, 28.1 and 30.1, respectively. Conveniently, each phase shifter may be composed of three sections, providing respectively, phase shifts of 180°, 90° and 45°. Each section is controlled by a pair of switching diodes, each of which is mounted in a special diode mount that will be described in detail in connection with FIGS. 4 and 5. Assuming that each phase shifter has three sections as described above, there are six such special diode mounts, 71, 72, 73, 74, 75 and 76 associated with and located adjacent each phase shifter. FIGS. 4 and 5 show the structural details of the first diode mount 71 of the fourth phase shifter 20, which is the same as all the special diode mounts for all four phase shifters in the entire five-port phase shifter device.

FIG. 4 shows a partial section through the fourth phase-shifter 20, taken on line 4—4 of FIG. 3. A part of the phase shifter is made of solid dielectric TEM-mode strip transmission line and a part is made of air-dielectric transmission line. A line 21 marks the boundary between these two parts in the fourth phase shifter 20 (FIG. 3); a line 19 marks the corresponding boundary in the third phase shifter 18. The part of the fourth phase shifter 20 having solid dielectric (FIG. 4) has two dielectric members 78, 79 holding a strip conductor 80 between them, and being in turn held between the plates 50 and 54. The strip conductor 80 extends toward the diode mount 71 from its location between the dielectric members 78, 79. Conveniently, the strip conductor can be made of solid metal, or it can be a film of conductor material supported on a thin dielectric substrate. In a practical phase shifter of known form, a sheet of such substrate extends the full length of the phase shifter, and strip conductors in film-form are provided on it leading to each diode.

The diode mount 71 is composed of a block 82 of electrically-conductive material having a bore 83 parallel to and intermediate between the plates 50, 54 in which a diode stud mount 84 is fitted. A diode 86 is mounted at one electrode directly to one end of the diode stud mount and is connected at the other electrode via a flexible conductor strap 88 to the strip conductor 80 of the phase shifter. A nut 87 holds the stud mount 84 in the block 82. A dc bias conductor 85 is connected to the diode between the nut 87 and the block 82. The block 82 is fitted at its outer parallel surfaces (FIG. 5) with dielectric sheet members 92, 94 and these in turn are covered with electrically-conductive sheet members 96, 98, respectively. The block 82 and all the sheet members 92, 94, 96 and 98 are fastened together, as by a suitable cement or double sided dielectric tape, to form a rigid unit that can be independently installed between the plates 50 and 54. To that end, the distance between the outer surface of the outer conductive sheet members 96, 98 is the same as the spacing between the inner surfaces of the plates 50 and 54. The outer sheet members 96 and 98 of each diode mount 71, etc., are notched at their ends as is indicated in FIGS. 2 and 3, to make passage-way studs 52, one at each end of each diode mount, to locate and tighten the special diode mounts between the plates 50, 54 in the completed structure.

Figure 6:
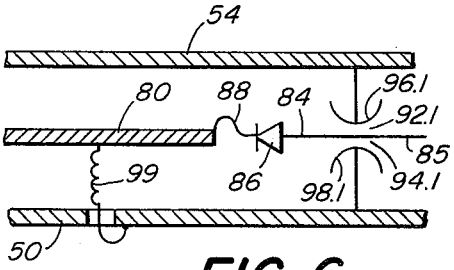
FIG. 6 is a schematic illustration of the diode mount and rf by-pass circuit shown in FIG. 4.

Referring to FIG. 6, when a special diode mount and a diode are installed in the phase shifter structure, the dielectric members 92, 94 function as the dielectric parts of RF by-pass capacitors 92.1 and 94.1, having the outer plate members 96, 98 as one capacitor plate 96.1 or 98.1, respectively, of each. The block 82 provides the second capacitor plate for each such capacitor. The dc bias lead 85 is connected (via the stud mount 84) to one side of the diode 86. A RF choke 99 is illustrated in FIG. 6, to complete the dc bias path. This item is normally a part of the phase shifter 20, and selected ones of the mounting studs 52, as exemplified by stud 52.1 cooperating with electrically conductive sleeves 52.2, can be used to provide part of a dc return to the plates 50, 54.

Figure 7:
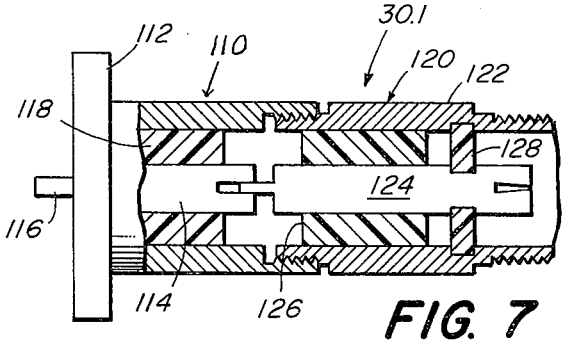
FIG. 7 is a longitudinal section through an output port coaxial coupler including a phase-trim section.
Figure 8:
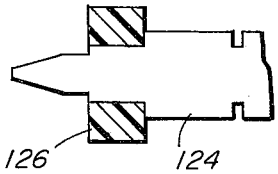
FIG. 8 shows an alternative phase-trim section.

FIG. 7 shows one of the coaxial output couplers 30.1, which is representative of all four couplers 24.1, 26.1, 28.1 and 30.1. It includes a base section 110 having a mounting flange 112 for attachment to an appropriate part of the enclosure 50, 54, 58 such as the edge rail 58, and an inner coaxial conductor 114 which extends into the enclosure and connects at the left-hand end 116 to the output end 30 of the relevant port of the multi-port phase shifter assembly. In well-known fashion, the inner conductor is supported in the outer conductor by a dielectric sleeve 118. A coaxial phase offset or trim section 120 comprises an outer conductor 122, an inner conductor 124 and a coaxial sleeve 126 for locating the inner conductor within the outer conductor and to contribute to providing the appropriate electrical parameters. A dielectric locking washer 128 completes the assembly. The phase-trim section 120 can have an inner conductor 124 and a sleeve 126 having one of a plurality of relative dimensions, but the outer conductor will in all cases have the same outer diameter and axial length and the inner conductor 124 will in all cases have the same axial length. The diameter of the inner conductor 124, and the thickness and axial length of the sleeve 126, can be varied from one phase-trim section to the next, as shown for example in FIG. 8, to provide a selection of phase-trim increments or off-set values, while maintaining constant the outer diameter and axial length, and the electrical impedance. A phase-trim section employing air dielectric throughout its length can also be used.

I claim:

1. An electric wave phase-shift device comprising an enclosing structure, and on the outside of said structure an input terminal and a plurality of output terminals, means within said enclosing structure providing wave paths from said input terminal to each of said output terminals for guiding to each output terminal a portion of wave energy introduced at said input terminal, individual phase shift means within said enclosing structure in each of said paths for establishing at said output terminals a prescribed phase state of each of said portions relative to the energy introduced at said input terminal wherein said phase shift means has a TEM-mode transmission line within said enclosing structure having at least a first ground-plane conductor and a strip conductor adjacent thereto, said phase-shifter having diode means with at least two electrodes, and an electrically-conductive mount therefor located adjacent said ground plane conductor, means coupling an electrode of said diode means to said mount, means coupling another electrode of said diode means to said strip conductor, and means capacitively coupling said mount to said ground plane conductor, a coupler at each of said output terminals, and an individual phase-trimming means in each of said couplers, whereby the relative phase states of wave energy available from said respective output terminals at a given instant can be adjusted without invading said enclosing structure.

2. An electric wave phase-shift device comprising an enclosing structure, and on the outside of said structure an input terminal and a plurality of output terminals, means within said enclosing structure providing wave paths from said input terminal to each of said output terminals for guiding to each output terminal a portion of wave energy introduced at said input terminal, individual phase shift means within said enclosing structure in each of said paths for establishing at said output terminals a prescribed phase state of each of said portions relative to the energy introduced at said input terminal wherein said phase shift means has a TEM-mode transmission line within said enclosing structure having a first and second ground-plane conductors spaced a prescribed distance apart and a strip conductor between said ground-plane conductors, said phase-shifter having diode means with at least two electrodes, and an electrically-conductive mount therefor located between said ground plane conductors, means coupling an electrode of said diode device to said mount, means coupling another electrode of said diode means to said strip conductor, and means capacitively coupling said mount to said ground plane conductor, a coupler at each of said output terminals, and an individual phase-trimming means in each of said couplers, whereby the relative phase states of wave energy available from said respective output terminals at a given instant can be adjusted without invading said enclosing structure.

3. A device according to claim 2 wherein said mount comprises a solid structure having two substantially parallel and planar outer boundary walls the outer surfaces of which are substantially said prescribed distance apart for establishing a spacing between said ground-plane conductors, and means to clamp said ground-plane conductors to said structure when said structure is located between said ground-plane conductors.

4. A device according to claim 3 wherein said solid structure is made of an electrically-conductive core member having a first two substantially parallel walls spaced less than said prescribed distance apart, a layer of a dielectric material on the outer surface of each of said first two walls, a layer of electrically conductive material on the outer surface of each dielectric layer, and means fastening said layers and said core member together to form said solid structure, the outer surfaces of said layers of electrically conductive material defining said outer boundary walls, and means locating said solid structure between said ground plane conductors in electrical contact respectively with said outer surfaces, said dielectric layers providing said capacitive coupling.

5. A device according to claim 3 wherein a bore traverses said solid structure in a direction parallel to said ground plane conductors and substantially halfway between them, and an elongated member fitted in said bore holds said diode means on one end thereof.

6. An electric wave phase-shift device comprising an enclosing structure, and on the outside of said structure an input terminal and a plurality of output terminals, means within said enclosing structure providing wave paths from said input terminal to each of said output terminals for guiding to each output terminal a portion of wave energy introduced at said input terminal, individual phase shift means within said enclosing structure in each of said paths for establishing at said output terminals a prescribed phase state of each of said portions relative to the energy introduced at said input terminal, a coupler at each of said output terminals, and an individual phase-trimming means in each of said couplers, wherein each said phase trimming means is a replaceable section of said coupler that is selectable from among a plurality of sections each having the same exterior physical length and the same characteristic electrical impedance but a unique electrical length corresponding to a preselected increment of phase shift, whereby the relative phase states of wave energy available from said respective output terminals at a given instant can be adjusted without invading said enclosing structure.

7. A device according to claim 6 wherein each said coupler is a coaxial connector, and each replaceable section is a length of coaxial line having the same physical length as all the others but having its inner conductor and the dielectric material between its inner and outer conductors relatively proportioned according to known prior art to provide said unique electrical length.

* * * * *